US005711167A

United States Patent [19]

Ha et al.

[11] Patent Number: 5,711,167

[45] Date of Patent: Jan. 27, 1998

[54] HIGH EFFICIENCY NITROGEN GENERATOR

[75] Inventors: Bao Ha, Vacaville, Calif.; Michael A. Turney, Houston, Tex.

[73] Assignee: Air Liquide Process & Construction, Houston, Tex.

[21] Appl. No.: 583,792

[22] Filed: Jan. 29, 1996

Related U.S. Application Data

[63] Continuation of Ser. No. 397,340, Mar. 2, 1995, abandoned.

[51] Int. Cl.[6] ..... F25J 3/00

[52] U.S. Cl. ..... 62/652

[58] Field of Search ..... 62/652

[56] References Cited

U.S. PATENT DOCUMENTS

| | | | |
|---|---|---|---|
| 4,222,756 | 9/1980 | Thorogood | 62/13 |
| 4,566,887 | 1/1986 | Openshaw | 62/21 |
| 4,662,917 | 5/1987 | Cormier, Sr. et al. | 62/39 |
| 4,848,996 | 7/1989 | Thorogood | 62/39 |
| 4,872,893 | 10/1989 | Agrawal et al. | 62/11 |
| 4,883,519 | 11/1989 | Agrawal et al. . | |
| 4,927,441 | 5/1990 | Agrawal | 62/28 |
| 4,966,002 | 10/1990 | Parker et al. | 62/31 |
| 5,170,630 | 12/1992 | Stern | 62/24 |

*Primary Examiner*—Ronald C. Capossela
*Attorney, Agent, or Firm*—Robert D. Touslee

[57] ABSTRACT

A process and apparatus is disclosed for highly efficient generation of nitrogen product in a single column arrangement. Oxygen-enriched liquid from a distillation column is partially vaporized to form a liquid and a vapor phase. The liquid is vaporized in a second reboiler/condenser and thereafter the vapor expanded to provide process refrigeration. The vapor portion having higher nitrogen content is compressed and returned to the distillation column for higher overall nitrogen recovery.

13 Claims, 2 Drawing Sheets

HIGH EFFICIENCY NITROGEN GENERATOR

This is a continuation of application Ser. No. 08/397,340 filed on Mar. 2, 1995 now abandoned.

FIELD OF THE INVENTION

The present invention is directed to a highly efficient process and apparatus for the generation of nitrogen from air in a cryogenic environment.

BACKGROUND OF THE INVENTION

Numerous processes for the generation of nitrogen from air are known in the art. Where the primary product is nitrogen, single column processes for the separation of air at cryogenic conditions utilizing an oxygen-enriched stream for expansion and refrigeration for the process is well known.

One such basic process and apparatus for the generation of nitrogen using waste oxygen-enriched stream expansion is described in U.S. Pat. No. 4,222,756. In this basic process, compressed dried feed air with impurities removed is cooled to near the dew point and fed to the lower part of a single distillation column wherein it is separated into a nitrogen-enriched stream at the top of the column and an oxygen-enriched stream at the bottom of the column. The oxygen-enriched liquid is withdrawn from the bottom of the column and following expansion is delivered to a reboiler/condenser wherein heat transfer by indirect heat exchange from a portion of the nitrogen-rich vapor from the top of the column. Following the indirect heat exchange, the gaseous oxygen-enriched stream is withdrawn from the reboiler/condenser and expanded to provide refrigeration for the process. The nitrogen-enriched vapors condensed in the reboiler/condenser are returned to the single distillation column as reflux. Typically, the gaseous oxygen-enriched stream comprises between about 35% and 38% oxygen.

U.S. Pat. No. 4,848,996 discloses modifications to the basic nitrogen generation process described above with reference to U.S. Pat. No. 4,222,756. In this process, distillation stages are added in a fractionation section above the reboiler/condenser for the purpose of stripping oxygen from the gaseous oxygen-enriched stream. With a relatively lower oxygen content, the gaseous stream removed from the reboiler/condenser above the second fractionation section is described to be of a composition similar to air, and the "synthetic air" is recycled for compression and mixing with the main feed air stream to the bottom of the main distillation column. To provide refrigeration for the process, a gaseous stream above the reboiler/condenser, and below the fractionation section of the upper column, is removed from the upper fractionation column and expanded in an expansion device. The oxygen-enriched vapor stream withdrawn for expansion has an oxygen content of between about 40% and 45%.

In U.S. Pat. No. 4,927,441, further modifications to the process described in U.S. Pat. No. 4,848,996 are disclosed. The process described in U.S. Pat. No. 4,927,441 retains the use of a distillation section in the upper column which also comprises the reboiler/condenser for the stripping of oxygen from the oxygen-rich stream from the bottom of the main column and to produce a "synthetic air". However, following the separation by distillation of the oxygen-enriched stream from the main column into a second oxygen-enriched liquid and synthetic air at the top of the second column, a liquid stream comprising the second oxygen-enriched liquid is withdrawn and expanded into a second reboiler condenser where it is vaporized and thereafter flowed to an expansion device to provide refrigeration for the process. As with the process described in U.S. Pat. No. 4,848,996, the synthetic air stream in this process is also produced to enable mixing directly with main feed air to the main distillation column. The process of U.S. Pat. No. 4,927,441 describes returning the synthetic air either to an interstage of the main air compressor or to a separate recycle compressor and thereafter combining the compressed synthetic air with the feed air stream prior to cooling. Among other factors, the shortcomings of the processes described above is the complexities of the air convection train which includes a side feed stream. Additionally, the purification and cooling sections are required to be larger in size, resulting in a greater capital cost.

Another modification of the basic single column nitrogen generator is disclosed in U.S. Pat. No. 4,966,002. In this process, oxygen-enriched liquid is withdrawn from the bottom of the single distillation column and expanded into the reboiler/condenser to provide for condensation of nitrogen-enriched vapors which in turn are returned as reflux to the top of the distillation column. From the reboiler/condenser a gaseous stream is withdrawn and thereafter split into two streams. The first such divided stream is expanded in an expansion device to provide process refrigeration. The second such divided stream, which along with the first divided stream has an oxygen content of between about 45% and 50%, is warmed to ambient temperature, and thereafter, compressed, cooled, and recycled to the distillation column, or alternatively, to a cold compressor and returned to the column. The ratio of the divided waste nitrogen streams may vary in the process of U.S. Pat. No. 4,966,002, however, the composition of both such divided streams is the same. The waste stream and the recycled stream have the same concentration of nitrogen, which results in loss of potential nitrogen recovery in the overall process.

SUMMARY OF THE INVENTION

The present invention provides for a process carried out under cryogenic conditions in an apparatus providing for an efficient recovery of nitrogen from air. In the process of the present invention, a gaseous feed stream is rendered free of impurities, compressed, dried, and cooled, and thereafter, delivered to a feed point in a distillation column. In the distillation column, a nitrogen-enriched vapor is formed at the top, and an oxygen-enriched liquid at the bottom of the column. A portion of the nitrogen-enriched vapor is condensed by indirect heat exchange with a portion of the oxygen-enriched liquid from the bottom of the distillation column in a first reboiler/condenser and thereafter at least partially returned as reflux to the top of the distillation column. The oxygen-enriched liquid stream used to condense the portion of nitrogen-enriched vapor is partially vaporized to result in a liquid fraction relatively rich in oxygen, and a vapor fraction relatively rich in nitrogen. The vapor fraction is withdrawn and compressed for recycle to the distillation column. The liquid fraction rich in oxygen is extracted and expanded into a second reboiler/condenser wherein it forms an oxygen-enriched vapor and a nitrogen-condensate by indirect heat exchange with at least a portion of nitrogen-enriched vapor, at least a part of which vapor is thereafter expanded to provide refrigeration for the overall process. Providing the reboil for the vaporization of the liquid fraction rich in oxygen is a portion of the nitrogen-enriched vapor from the distillation column which, following condensation in the second reboiler/condenser, is preferably returned to the distillation column as reflux.

In the process of the present invention, the distillation is carried out in a single distillation column, and there are no distillation sections in either of the reboiler/condenser sections. The withdrawal of liquid comprising a relatively higher portion of oxygen than the equilibrium vapor from the first reboiler/condenser provides a high nitrogen concentration in the recycle stream, and thereby, higher overall nitrogen recovery.

In the preferred embodiment of the present invention, the expansion turbine which expands a portion of the oxygen-enriched vapor from the second reboiler/condenser is integrally coupled with a cold compressor which serves to compress the recycled nitrogen-enriched vapor from the first reboiler/condenser to the distillation column.

DETAILED DESCRIPTION OF THE INVENTION

Figure 1:
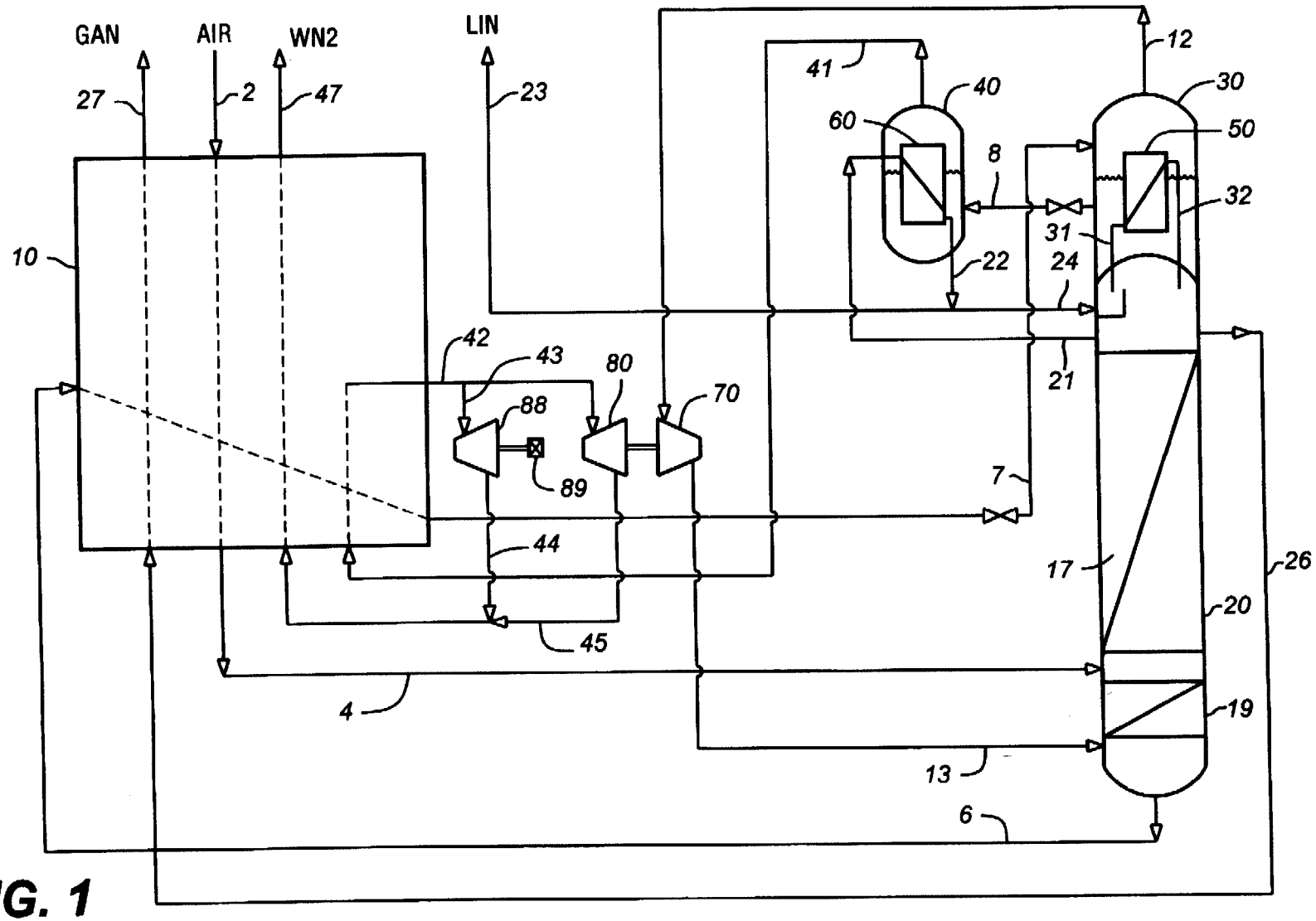
FIG. 1 is a schematic view of one embodiment of the present invention depicting major process streams and apparatus components.
Figure 2:
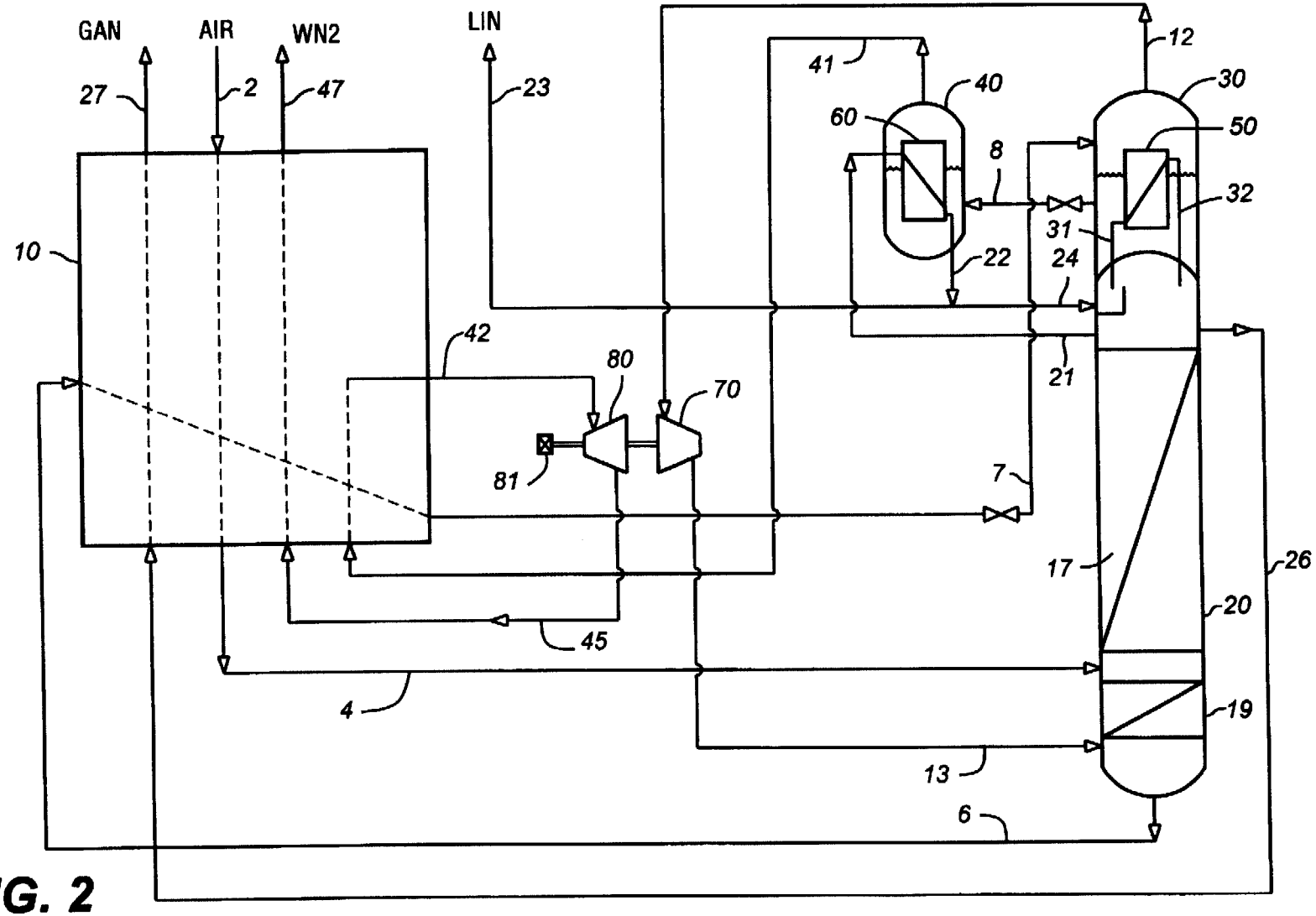
FIG. 2 is a schematic view of another embodiment of the present invention comprising a dissipative brake assembly and depicting major process streams and apparatus components.

Referring to the Figure wherein the preferred embodiment of the present invention is depicted, a feed air stream 2 is cooled in main heat exchanger 10 and delivered to the distillation column 20 in feed line 4. Before delivery to the distillation column, the feed air stream is dried and purified using well known techniques which may comprise, for example, adsorbers, filters, additional heat exchangers, or the like. In the single distillation column 20, oxygen is stripped in distillation section 17 and a nitrogen-enriched vapor is formed above the distillation section. At the bottom of the distillation column 20, an oxygen-enriched liquid stream 6 is withdrawn and subcooled against other process streams in main heat exchanger 10. Thereafter, the oxygen-enriched liquid stream is expanded and delivered to condenser section 30 via line 7. The first condenser section 30 comprises a first reboiler/condenser 50 wherein a first portion of the nitrogen-rich vapor from the distillation column are delivered via line 31, condensed by indirect heat exchange with the oxygen-enriched liquid stream and the nitrogen condensate returned to the distillation column as reflux in line 32. If desired, a portion of the nitrogen condensate may be withdrawn as a liquid nitrogen product.

The vaporization of a portion of the oxygen-enriched liquid stream in condenser section 30 results in a liquid phase and a nitrogen-enriched vapor phase in the shell of condenser section 30. In accordance with the present invention, each of such phases having different composition are further processed to provide highly efficient recovery of nitrogen product. The liquid formed in first condenser section 30 is withdrawn, at least a portion expanded and delivered via stream 8 to a second condenser section 40 which comprises reboiler/condenser 60. In accordance with the present invention, at least a portion of the oxygen-rich liquid from the first condenser shell is vaporized in second condenser 40 by indirect heat exchange with at least a portion of the nitrogen-enriched vapor from the distillation column. Such second portion of nitrogen-enriched vapor is delivered to reboiler/condenser 60 via line 21 and produces a condensed nitrogen-enriched liquid in the condenser 40 which is withdrawn from condenser 40 via line 22, and at least a portion returned as reflux to the distillation column via line 24. Optionally, a liquid nitrogen product may be withdrawn from the second condenser via line 23. If desired, the liquid nitrogen produced may comprise either nitrogen condensate from the first condenser, second condenser, or a combination comprising both sources.

In accordance with the present invention, vaporized oxygen-enriched stream 41 is warmed against other process streams to form warmed oxygen-enriched stream 42. At least of portion of warmed oxygen enriched stream 42 is expanded in expansion device 80 to form expanded waste stream 45 which is further warmed against process streams in the main heat exchanger and thereafter taken from the process as waste stream 47.

The vapor formed in first condenser section 30 is withdrawn in line 12 and delivered to compressor 70 and following compression thereafter delivered in line 13 to the distillation column. In accordance with the present invention, the vapor stream 12 withdrawn from condenser 30 has a higher oxygen content than feed air, and it is preferable the stream be recycled following compression to a point at least one theoretical stage below the feed point of main feed air in line 4. Typically, said recycle stream comprises between 25 and 29 mole percent oxygen and said waste stream comprises greater than 46 mole percent oxygen. Preferably, a distillation section 19 is disposed between the main air feed point and the point in the distillation column where recycle oxygen enriched stream 13 is returned.

In the preferred embodiment of our invention, expansion device 80 is mechanically coupled to compressor 70 such that at least some of the energy of expansion is directly used for to compression, and compressor 70 is preferably a cold compressor which is mechanically integrated with expansion device 80. In such preferred case, an energy absorption device 89 is used to dissipate energy of expansion of a portion of stream 42 in device 88, for thermal balance in the process. The devices 80 and 88 can be combined as a single device coupled to compressor 70. In this configuration a brake device can be attached to the shaft of the coupled system to dissipate a portion of the energy, to keep the overall process in balance.

Gaseous nitrogen product is withdrawn from the top of distillation column 20 and delivered to the main heat exchanger in line 26 to be warmed and available as gaseous nitrogen product in line 27.

Among other factors, one advantage of the process and apparatus of the present invention is that a higher pressure may be maintained in condenser section 30, since a liquid stream is withdrawn enabling the vaporized stream to contain less oxygen. Further, if condenser 30 is operated at higher pressure, the work required by compressor 70 is lessened, and therefore higher recycle flow can be achieved at the same power input for compressor 70. In the processes of the present invention, higher recycle flow together with an increased nitrogen concentration translates to a higher overall recovery of nitrogen. Other advantages will become apparent to those skilled in the art once having the benefit of the herein provided description of the present invention, and the examples provided below.

EXAMPLE

The invented process has been simulated for a nitrogen generator having a nitrogen product flow of 100,000 SCFH at 124 psia and 1 ppm oxygen purity.

A dry and clean atmospheric air stream (sbstantially free of nitrogen and $CO_2$) of 173,549 SCFH at 132 psia and 60°

F. (stream 2) is cooled in exchanger 10 to a temperature of −268° F. before entering an intermediate stage of the distillation column 17 via stream 4.

A oxygen rich liquid flow of 132,519 SCFH containing 39.77 mol percent oxygen was withdrawn from the bottom of column 17 via stream 6, subcooled in exchanger 10 to −277.6° F., expanded across a valve and fed to the main vaporizer shell 30 via stream 7. A gaseous oxygen rich recycle stream 12 having a flow of 58,971 SCFH and 27.7 mol percent oxygen exits the main vaporizer 30 at 74.9 psia and −279.4° F. Stream 12 was then compressed in recycle booster 70 to 129.8 psia and fed to the bottom of the column 17. The balance of the oxygen rich liquid which was fed to the main vaporizer 30 was withdrawn via stream 8 and vaporized in the auxiliary vaporizer 40 at 57.75 psia and −279.4° F. This gaseous oxygen rich waste stream 41 was warmed in the main exchanger 10 to −238° F., expanded in turbines 80 and 88, then reentered the main exchanger 10 where it was warmed to 55° F. The waste stream 47 has a flow of 73,548 SCFH and contained 49.5 mol percent oxygen.

A gaseous nitrogen stream with a flow of 100,000 SCFH at 126.4 psia and −276.6° F. was withdrawn from the top of distillation column 17 via stream 26, warmed in exchanger 10 and delivered as product at 124 psia and 55° F. by stream 27.

To illustrate the advantages, the process given by FIG. 4 of U.S. Pat. No. 4,966,002 was simulated to compare the air feed requirement to the present process. Similar production requirements, heat leaks, exchanger temperature pinches, column operating pressures, etc. were used in carrying out the simulation.

The simulation results showed air feed to the cold box is reduced by 4.55% when compared to the process of FIG. 4 of U.S. Pat. No. 4,966,002.

While particular embodiments of the invention have been described herein, it is to be understood that the scope of the invention is solely defined by the claims appended hereto.

What is claimed is:

1. A process for the production of highly pure nitrogen product from air by cryogenic separation, comprising the steps of:

(a) feeding a compressed, dry, cleaned, and cooled feed air stream to a distillation column at a feed stage;

(b) separating said feed air in said distillation column to form a nitrogen-enriched vapor at the top of the column, and an oxygen-enriched liquid at the bottom of the column;

(c) condensing in a first condenser a portion of said nitrogen-enriched vapor by indirect heat exchange with at least a portion of said oxygen-enriched liquid which at least partially vaporizes to form an oxygen-rich liquid and a second nitrogen-enriched vapor;

(d) vaporizing at least a portion of said oxygen-rich liquid in a second condenser by indirect heat exchange with at least a portion of said nitrogen-enriched vapor to produce a waste stream and a nitrogen-enriched condensate;

(e) recycling a least a portion of said second nitrogen-enriched vapor to a recycle compressor to form a compressed recycle stream;

(f) feeding at least a portion of said compressed recycle stream to said distillation column at least one theoretical stage below said feed stage of said feed air; and (g) warming and expanding at least a portion of said waste stream in an expansion device to provide refrigeration for said process.

2. The process as recited in claim 1 wherein at least a portion of said nitrogen-enriched condensate is removed as liquid nitrogen product.

3. The process as recited in claim 1 wherein all of said nitrogen-enriched condensate from said second condenser is returned as reflux to said distillation column.

4. The process as recited in claim 1 wherein at least a portion of said nitrogen-enriched vapor condensed in said first condenser is removed as liquid nitrogen product.

5. The process as recited in claim 1 wherein said recycle stream comprises between 25 and 29 mole percent oxygen and said waste stream comprises greater than 46 mole percent oxygen.

6. The process as recited in claim 1 wherein said expansion device is mechanically coupled to said recycle compressor.

7. The process as recited in claim 6 wherein said compressor is a cold compressor and said oxygen enriched vapor delivered to said cold compressor is less than −50 degrees Celsius.

8. The process as recited in claim 7 further comprising expanding a portion of said waste stream in a second expansion device mechanically coupled to an energy-dissipating device.

9. The process as recited in claim 1 wherein substantially all of said oxygen-rich condensate is vaporized, warmed and expanded in said expansion device.

10. The process as recited in claim 1 wherein at least a portion of said feed air is stripped in a stripping zone in said distillation column to produce at least a portion of said oxygen-enriched liquid.

11. An apparatus for the production of nitrogen product under cryogenic conditions comprising:

(a) a heat exchanger to cool a feed air stream against products of feed air distillation;

(b) a distillation column for separating said feed air into a substantially nitrogen vapor and an oxygen-enriched liquid;

(c) a first condenser capable of vaporizing said oxygen-enriched liquid to form an oxygen-rich condensate and a nitrogen-enriched recycle stream by indirect heat exchange with a portion of said substantially nitrogen vapor;

(d) means for withdrawing said oxygen-rich liquid and delivering said oxygen-rich liquid to a second condenser;

(e) means for withdrawing said nitrogen-enriched recycle stream and delivering such nitrogen-enriched recycle stream to a recycle compressor;

(f) indirect heat exchange means in said second condenser to provide for vaporization of said oxygen-rich liquid;

(g) means to withdraw said waste stream and delivering said waste stream to said heat exchanger;

(h) compressor means to compress said nitrogen-enriched recycle stream; and (i) means to deliver a portion of said nitrogen-enriched vapor to said heat exchanger for warming against other process streams.

12. The apparatus as recited in claim 11, further comprising:

(a) means to withdraw said waste stream from said heat exchanger and expand at least a portion of said waste stream in at least one expansion device.

13. The apparatus as recited in claim 12, further comprising:

(a) stripping means in said distillation column below said feed point; and (b) means to deliver compressed nitrogen-enriched recycle stream from said compressor to said distillation column below said stripping section.

* * * * *